US008857343B2

(12) United States Patent
Marx

(10) Patent No.: US 8,857,343 B2
(45) Date of Patent: Oct. 14, 2014

(54) HIGH VOLUME MULTIPLE COMPONENT PROJECTILE ASSEMBLY

(71) Applicant: Liberty Ammunition, Inc., Bradenton, FL (US)

(72) Inventor: P J Marx, Sarasota, FL (US)

(73) Assignee: Liberty Ammunition, LLC, Bradenton, FL (US)

( * ) Notice: Subject to any disclaimer, the term of this patent is extended or adjusted under 35 U.S.C. 154(b) by 0 days.

(21) Appl. No.: 13/657,207

(22) Filed: Oct. 22, 2012

(65) Prior Publication Data

US 2014/0261046 A1 Sep. 18, 2014

Related U.S. Application Data

(60) Provisional application No. 61/652,653, filed on May 29, 2012.

(51) Int. Cl.
*F42B 30/02* (2006.01)

(52) U.S. Cl.
USPC ..... 102/517; 102/518; 102/519; 102/501

(58) Field of Classification Search
USPC ..... 102/517, 506, 518–520, 522–527
See application file for complete search history.

(56) References Cited

U.S. PATENT DOCUMENTS

| | | | | |
|---|---|---|---|---|
| 40,153 | A | 10/1863 | Billings | |
| 2,322,751 | A | 6/1943 | Studler | |
| 2,946,261 | A | 7/1960 | Crockett | |
| 3,348,486 | A | 10/1967 | Rapp | |
| 3,795,196 | A * | 3/1974 | Hillenbrand | 102/518 |
| 3,913,489 | A | 10/1975 | Trevor et al. | |
| 3,952,657 | A | 4/1976 | Kaltmann | |
| 5,686,693 | A | 11/1997 | Jakobsson | |
| 6,305,293 | B1 | 10/2001 | Fry et al. | |
| 6,317,946 | B1 | 11/2001 | Beal | |
| 6,439,125 | B1 | 8/2002 | Carter | |
| 7,207,275 | B1 | 4/2007 | Oertwig | |
| 7,219,607 | B2 | 5/2007 | Oertwig | |
| 7,222,573 | B2 | 5/2007 | Pontieri | |
| 7,451,706 | B2 | 11/2008 | Meyer | |
| 7,748,325 | B2 | 7/2010 | Marx | |
| 7,900,561 | B2 | 3/2011 | Marx | |

(Continued)

OTHER PUBLICATIONS

International Search Report for PCT/US2013/043081 with an International filing date of May 29, 2013 and a mailing date of Mar. 6, 2014.

*Primary Examiner* — Daniel J Troy
(74) *Attorney, Agent, or Firm* — Ronald E. Smith; Anton J. Hopen; Smith & Hopen, P.A.

(57) ABSTRACT

A projectile includes a head, a tail, and an interface that interconnects the head and tail. Multiple sections of the interface are deformed by being compressed radially inwardly into respective annular recesses formed between the interface and the head and tail during manufacturing or by rifling when the projectile is fired. The amount of deformation is controlled by the depth of each of the annular recesses. In all embodiments, annular ridges formed in the head, the tail, or both, define the longitudinal extent of the annular recesses. The interface includes an annular obturation region and has a beveled open leading end to facilitate insertion of the head and tail into the interface.

8 Claims, 6 Drawing Sheets

(56) References Cited

U.S. PATENT DOCUMENTS

| | | | | |
|---|---|---|---|---|
| 2005/0183617 | A1 | 8/2005 | MacDougall | |
| 2006/0027128 | A1 | 2/2006 | Hober | |
| 2007/0089628 | A1 | 4/2007 | Elder | |
| 2007/0089629 | A1 | 4/2007 | Marx | |
| 2010/0224093 | A1 * | 9/2010 | Wilhelm et al. | 102/507 |

* cited by examiner

HIGH VOLUME MULTIPLE COMPONENT PROJECTILE ASSEMBLY

BACKGROUND OF THE INVENTION

1. Field of the Invention

This invention relates to ammunition. More specifically, it relates to a projectile that is advantageously deformed by rifling.

2. Brief Description of the Related Art

Projectiles that include a head and a tail held together by an interface have enhanced performance characteristics relative to conventional projectiles.

However, the rifling in a gun barrel causes compression of the interface and the number of such compressions, as well as the location, depth and longitudinal extent of the compression is essentially uncontrollable, thereby reducing the effectiveness of the projectile. Accordingly, multiple projectiles fired in sequence will follow differing paths of travel due to the random quantity, location, depth and extent of the compressions formed in the interface.

The conventional wisdom is that such compression is a natural consequence of rifling and that nothing can be done about it.

In view of the art considered as a whole at the time the present invention was made, it was not obvious to those of ordinary skill in the field of this invention that the effects of excessive random rifling compressions could be reduced or eliminated. Thus it was not obvious how such effects could be reduced or eliminated.

BRIEF SUMMARY OF THE INVENTION

The long-standing but heretofore unfulfilled need for a projectile that is not subject to the limitations of prior art projectiles is now met by a new, useful, and nonobvious invention.

In all embodiments, the novel structure includes a head, a tail, and an interface that interconnects the head and tail.

In a first embodiment, the head includes a frusto-conical section that extends from a leading end of the head to a point about mid-length of the head. A diameter-reducing annular step is formed about mid-length of the head.

The depth of the diameter-reducing annular step is equal to the thickness of the leading edge of the interface so that the leading edge of the interface abuts the diameter-reducing annular step and an exterior surface of the interface is flush with an exterior surface of the head when the projectile is in its assembled configuration, i.e., the flush relationship is formed by annular compression of the interface to the diameter-reducing step.

A first annular ridge is formed in the head in trailing, longitudinally spaced apart relation to the diameter-reducing annular step. Accordingly, a first annular recess extends longitudinally from the diameter-reducing annular step to the first annular ridge.

A second annular ridge is formed in the head in trailing and longitudinally spaced apart relation to the first annular ridge, forming a second annular recess between the interface and the head that extends from the first annular ridge to the second annular ridge.

A third annular recess extends from the second annular ridge to the trailing edge of the head.

A third annular ridge is formed in a leading end of the tail.

The interface has an open leading end, a closed trailing end, an exterior surface, and a cavity defined by an interior surface. The closed trailing end has an exterior bottom wall and an interior bottom wall. An annular diameter-increasing step is formed in the interior surface of the interface about mid-length of a tail-receiving section of the interface.

Accordingly, a fourth annular recess is formed between the interface and the tail, extending from the third annular ridge to the annular diameter-increasing step formed in the interior surface of the interface.

The interface has first, second, third and fourth annular sections that are compressed radially inwardly during manufacturing or by rifling when the projectile is fired so that said annular sections are respectively disposed in the first, second, third and fourth annular recesses so that each of the annular sections of the interface are deformed to conform to the contour of said head and tail.

All of the deformations are positioned on the leading side of the annular obturation region. The deformations are advantageous because the amount of deformation is controlled by the depth of each of the annular recesses and the longitudinal extent of each of the annular recesses. Moreover, the quantity and location of each deformation is also under the control of the projectile manufacturer. This is in sharp contrast with the deformations of the prior art that are random in number, location, depth and extent and which therefore produce random flight paths for projectiles fired in sequence.

In a second embodiment, only one annular recess and one annular ridge is formed in the head. The annular ridge is formed in the trailing end of the head and the annular recess is formed in the head in leading relation to the annular ridge and in longitudinally spaced apart relation to the annular diameter-reducing step formed in the head. In this embodiment, the annular diameter-reducing step is formed in the head about one-third the distance from its leading end to its trailing end.

In the second embodiment, as in the first embodiment, an annular recess extends from the annular diameter-increasing step formed in the interior surface of the interface to the leading end of the tail. This annular recess extends about half the length of the tail.

A third embodiment is similar to the second because it includes one annular recess and one annular ridge formed in the head. The annular ridge is formed in the trailing end of the head as in the second embodiment but the annular recess formed in the head in leading relation to the annular ridge extends to the annular diameter-reducing step formed in the head, reducing gradually in depth as it approaches said annular diameter-reducing step. As in the second embodiment, the annular diameter-reducing step is formed in the head about one-third the distance from the leading end of the head to its trailing end.

In the third embodiment, as in the second embodiment, a second annular recess extends from the annular diameter-increasing step formed in the interior surface of the interface to the trailing wall of the head, i.e., to the annular ridge formed in the trailing end of the head.

In all embodiments, the exterior surface of the interface has a trailing end, a uniform diameter mid-section, and an open leading end that reduces slightly in diameter relative to the mid-section. The diameter of the mid-section is also slightly greater than the diameter of the trailing end. This difference in diameter creates an interface transition region between the trailing end of the interface and the uniform diameter mid-section.

An annular inflection or obturation region is formed in the interface transition region.

The open leading end of the interface has a beveled edge that guides the tail into the cavity of the interface when the tail is dropped into the cavity. Therefore there is no need for a time-consuming precise alignment between the open end of the interface and the tail. The trailing end of the tail is in spaced apart relation to the flat bottom wall of interface cavity when the tail is dropped into the interface cavity.

A ram has a frusto-conical cavity that matches the slope of the frusto-conical section of the head. The head and tail are pushed into the interface by the ram until the flat trailing wall of the tail abuts the flat interior bottom wall of the interface.

A radially inward crimp is formed in the open leading end of the interface after the tail and head have been inserted into the cavity of the interface. The crimp abuts the diameter-reducing step formed in the head.

In all embodiments, the interface is compressed into the annular recesses either prior to projectile firing or during such firing, there being four such annular recesses in the first embodiment and two such annular recesses in the second and third embodiments. However, since the quantity, location, depth, longitudinal extent of each annular recess is determined by the projectile manufacturer, the depressions formed in the interface are under the control of said manufacturer.

All embodiments eliminate the random number, random depth, random length, and random location of rifle-created depressions that are formed in prior art projectiles.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1A:
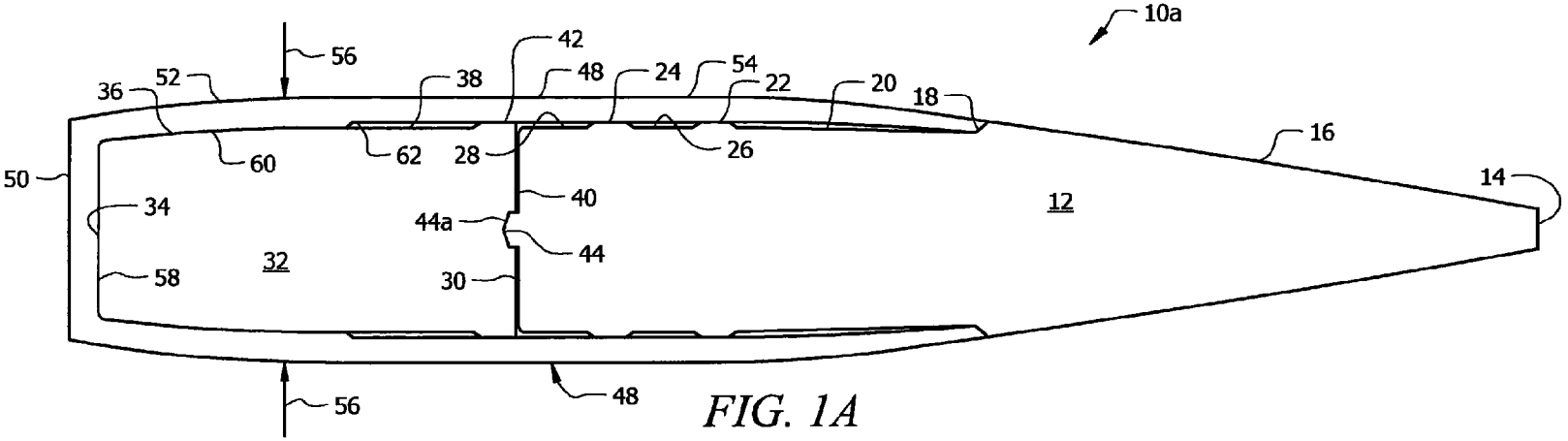
FIG. 1A is a longitudinal sectional view of a first embodiment of the novel projectile assembly.

A first embodiment of the novel structure is denoted as a whole in FIG. 1A by the reference numeral 10*a*.

Structure 10*a* includes head 12, tail 32, and interface 48. Head 12 is depicted individually in FIG. 1B, tail 32 is depicted individually in FIG. 1C, and interface 48 is depicted individually in FIGS. 1D and 1E.

Leading end 14 of head 12 can be flat as depicted, rounded, or pointed. Frusto-conical section 16 extends from leading end 14 to a point about mid-length the length of said head. Diameter-reducing annular step 18 is formed at said location and the diameter of head 12 is reduced from said step 18 to the trailing end of said head. The reduced diameter increases slightly but linearly as at 20 from said annular step 18 to first transversely disposed annular ridge 22. The diameter of head 12 is uniform from first ridge 22 to second transversely disposed annular ridge 24 and is again uniform until it reaches flat trailing wall 30.

The leading end of interface 48 abuts diameter-reducing annular step 18 and an interior surface of said interface is spaced apart from head 12 by the first and second transversely disposed annular ridges 22 and 24, thereby creating first, second and third annular recesses 20, 26 and 28.

Three annular recesses are thus created between interface 48 and head 12, said three spaces being denoted 20, 26, and 28.

Figure 1B:
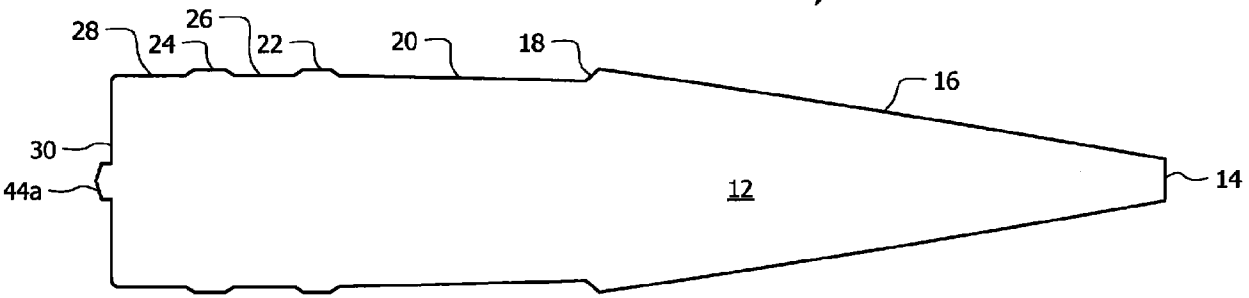
FIG. 1B is a longitudinal sectional view of the projectile head of the first embodiment.
Figure 1C:
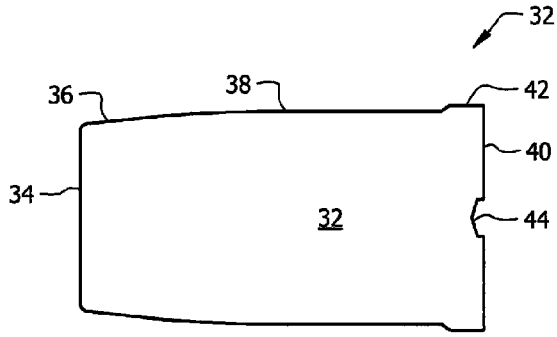
FIG. 1C is a longitudinal sectional view of the projectile tail of the first embodiment.

Tail 32, depicted in side elevation in FIGS. 1A and 1C, is preferably, for manufacturing purposes, a wire that is cold formed by being punched into a die cavity. The exterior surface of tail 32 therefore conforms to the shape of the die cavity. Tail 32 includes flat trailing wall 34, transition region 36 where its diameter increases slightly, uniform diameter section 38, and leading wall 40. The tail diameter increases at annular ridge 42 at the leading end of said tail.

Central concavity 44 formed in flat leading wall 40 is formed by a mirror image protuberance at the leading end of a ram that drives tail 32 into its die. Projection 44*a* formed in the trailing end of head 12 fits into said concavity 44.

FIG. 1B depicts head 12 of the first embodiment. It is preferably machined on a lathe although any other suitable manufacturing means is within the scope of this invention.

Figure 1D:
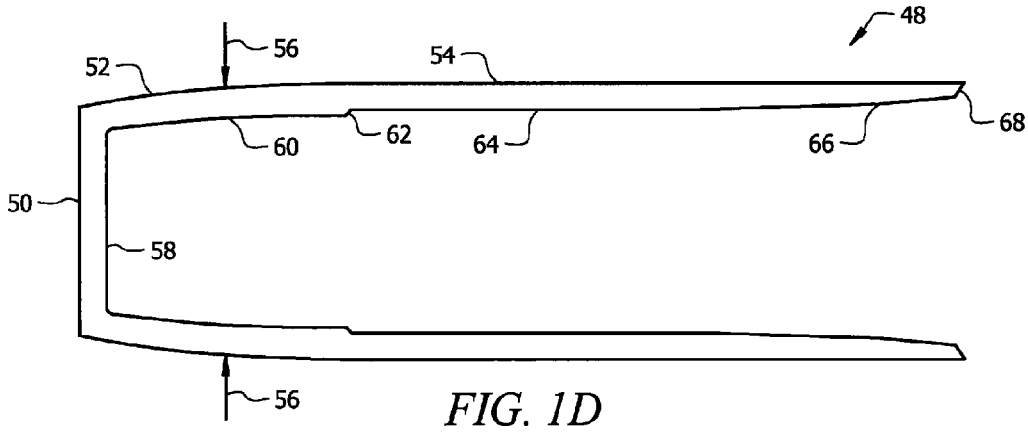
FIG. 1D is a longitudinal sectional view of the interface prior to assembly.
Figure 1E:
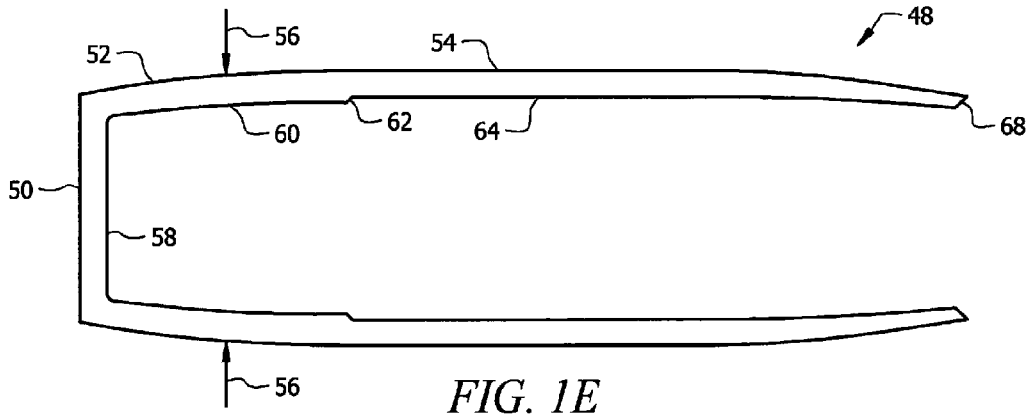
FIG. 1E is a longitudinal sectional view of the interface after assembly.

FIG. 1D depicts interface 48 prior to assembly and FIG. 1E depicts interface 48 after assembly, i.e., as it appears in FIG. 1A.

Interface 48 is cold formed by positioning a flat coin over a die having a cavity formed therein and by punching the coin into said cavity with a ram. The contour of the cavity determines the exterior shape of interface 48 and the contour of the ram determines the interior shape of interface 48.

The bottom wall of the cavity is flat, thereby forming flat exterior trailing end 50 and the leading end of the ram is flat, thereby forming interior flat bottom wall 58. The diameter of the cavity has its most narrow dimension at said bottom wall. A cavity diameter transition region is provided where the interior and exterior diameter of the cavity increases slightly as it extends away from said bottom wall, thereby forming interface transition region 52 in the exterior surface of interface 48. The diameter of the cavity is uniform from the opening of the cavity to said cavity diameter transition region, thereby forming uniform diameter region 54 of said interface.

The annular inflection point that marks the transition from increasing diameter section 52 to uniform diameter section 54 is indicated by confronting arrows 56 in FIGS. 1D and 1E. This annular region is known in the industry as the obturation point, band, or region.

The leading end of the ram is flat so that it forms flat interior surface 58 as aforesaid. The contour of the leading end of the ram produces curved interior surface 60 and an increase in diameter at a location away from its flat leading end produces annular diameter-increasing step 62 in the interior surface of interface 48.

An annular recess is thus created between interface 48 and tail 32, said annular recess being denoted 38 in FIG. 1A. This is the fourth annular recess in the first embodiment of the novel assembly and it extends from annular ridge 42 formed in tail 32 to said annular diameter-increasing step 62.

Thus, in the embodiment of FIG. 1A, there are four annular recesses formed between interface 48, head 12 and tail 32 with three of the four being between the interface and head 12.

As best understood in connection with FIG. 1D, the undepicted ram has a uniform diameter towards its leading end relative to annular step 62 to produce uniform diameter section 54 in interface 48. The ram then increases in diameter linearly to produce linearly diverging section 66 at the leading, open end of interface 48.

The open leading end of interface 48 is beveled as at 68 (FIGS. 1D and 1E). The bevel helps guide tail 32 into the hollow interior or cavity of interface 48 when said tail is dropped thereinto. More particularly, after interface 48 has been cold-formed from a flat coin at a first station by the punch and die, it is displaced by a conveyor or other suitable means to a second station where tail 32 is dropped thereinto from an overhead bowl or other device. Thus there is no need for a time-consuming precise alignment between the open end of interface 48 and tail 32.

Trailing end 34 of tail 32 will not abut flat bottom wall 58 of interface 48 when said tail 32 is dropped into said interface. Head 12 is dropped into the interface after tail 32 and flat trailing wall 30 of head 12 abuts leading wall 40 of tail 32 as depicted. As depicted in FIG. 1A, protuberance 44*a* formed in the trailing wall 30 of head 12 fits into concavity 44. This eliminates the need to remove said protuberance.

The undepicted ram having a frusto-conical cavity that matches the slope of frusto-conical section 16 of head 12 pushes head 12 and tail 32 into interface 48 until flat trailing wall 34 of tail 32 abuts flat bottom wall 58 of interface 48. Interface 48 is then crimped at its open leading end so that it assumes its FIG. 1A and FIG. 1E configuration.

As depicted in FIG. 1A, the above-disclosed contours create transversely disposed annular recesses 20, 26, 28, and 38 when head 12 and tail 32 are fully received within interface 48. Interface 48 is compressed radially inwardly by rifling when the projectile is fired so that it occupies each of said annular recesses. The radially inward compression may also be made during the manufacturing process. All compressions/deformations of interstitial space within interface 48 are on the leading side of obturation region 56. This compression is advantageous because it is a controlled deformation, as distinguished from a prior art random, uncontrolled deformation. The result is a projectile that more consistently hits its aiming point.

Figure 2A:
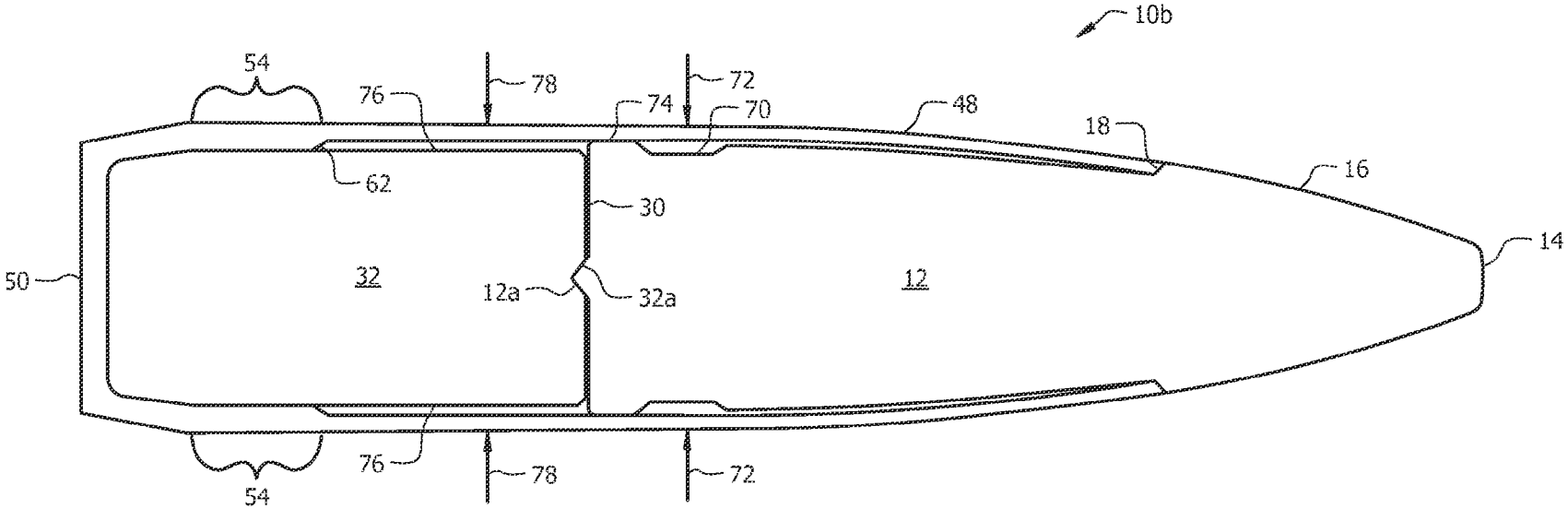
FIG. 2A is a longitudinal sectional view of a second embodiment of the novel projectile assembly.
Figure 2B:
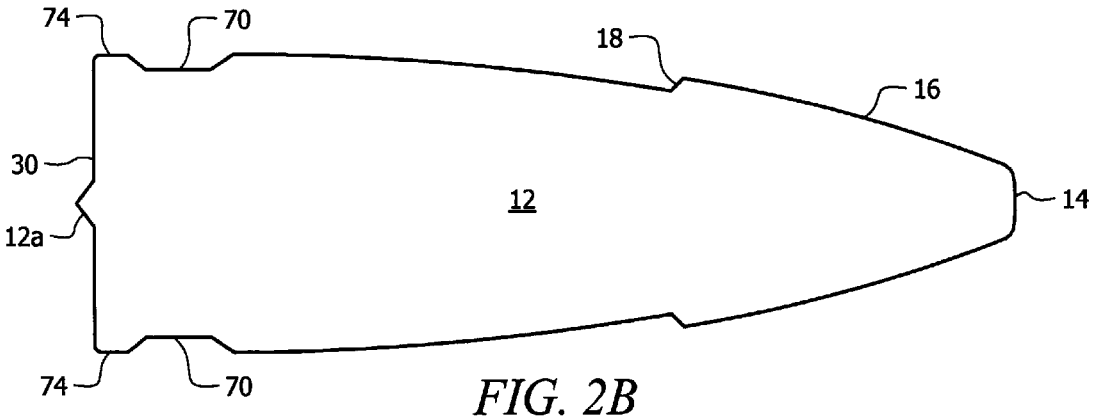
FIG. 2B is a longitudinal sectional view of the projectile head of the second embodiment.
Figure 2C:
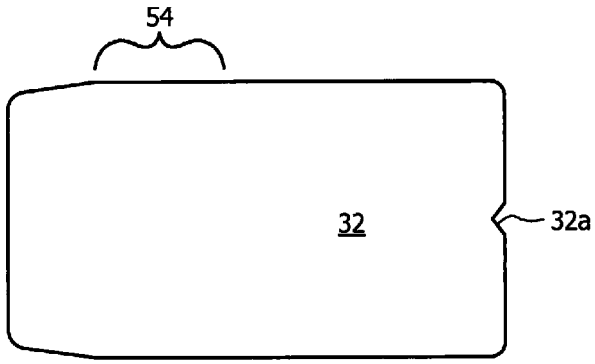
FIG. 2C is a longitudinal sectional view of the projectile tail of the second embodiment.

Referring now to the second embodiment, depicted in FIGS. 2A-C, instead of three (3) annular recesses between head 12 and interface 48 as in the first embodiment, there is but one (1) annular recess, denoted 70, formed in head 12. Annular recess 70 is formed in head 12 in leading relation to drive chamfer 74 which is provided in the form of an annular raised ridge formed in the trailing end of head 12, in trailing relation to annular recess 70. Drive chamfer 74 imparts spin to head 12.

Annular recess 70 is truncate in extent, having an extent similar to that of annular ridge 74. An elongate annular recess of less depth extends from the leading edge of recess 70 to diameter-reducing annular step 18. Prior to interface 48 deformation, the truncate and elongate parts of the recess are in open communication with one another. Accordingly, in the claims appended hereto, truncate recess 70 is referred to as the second part of the annular recess formed in head 12 and the elongate part of the recess is referred to as the second part of the annular recess formed in said head. The elongate second part reduces in depth as it approaches annular step 18 as depicted.

As depicted in FIG. 2A, notch 32*a* formed in the leading end of tail 32 receives protuberance 12*a* formed in the trailing end of head 12.

In this second embodiment, interface 48 is pre-compressed radially inwardly into annular recess 70 during assembly as indicated by directional arrows 72. The compression is produced by a cannelure die that also produces a bullet knurl with symmetrically arranged pronged teeth. A wheel die would deform the bullet shape.

In this second embodiment, annular diameter-reducing step 18 is formed in head 12 about one-third of the way from its flat leading end 14 to its flat trailing end 30. As in the first embodiment, the leading end of interface 48 has a thickness equal to the depth of step 18 so that an exterior surface of head 12 is flush with an exterior surface of interface 48.

The internal diameter of interface 48 in this second embodiment increases at diameter increasing step 62 so that annular recess 76 is created between said interface and tail 32. Annular recess 76 facilitates projectile assembly by reducing misalignment during such assembly. After assembly, radially inwardly directed arrows 78 indicate that interface 48 is compressed into annular recess 76. The compression may be accomplished during the assembly step after tail 32 is inserted into the cavity of interface 48, or the compression may take place during firing of the round.

Obturation band 54 is denoted with a bracket to indicate its length. As in the first embodiment, the function of obturation band 54 is to seal against gas pressure leakage.

Structural features associated with one or more preferred embodiments of the projectile include the nose and tail portions and respectively, formed of high density metal matrix composites, metals, alloys, or ceramics. More specifically, the nose and tail portions can each be formed from a material which contains one or more of the following: aluminum, antimony, beryllium, bismuth, boron carbide, brass, bronze, chromium, cobalt, copper, gold, iridium, iron, lead, magnesium, mercury, molybdenum, nickel, palladium, platinum, rhodium, silicon carbide, silver, steel, tantalum, tellurium, tin, titanium, tungsten, tungsten carbide, depleted uranium, zinc and zirconium.

Interface 18 may be made from a copper alloy similar to gilding metal. However, material from which interface 18 is formed may vary to include other appropriate alloys, polymers, etc., including materials which contain one or more of the following: aluminum, bronze, brass, chromium, copper, epoxy, fiberglass, Kevlar®, gold, graphite, iron, lead, magnesium, mercury, molybdenum, nickel, nylon, palladium, polycarbonate, polyester, polyethylene, polystyrene, polyamide, poly vinyl chloride, polyurethane, phenolic, thermoplastic polymer, thermoset polymer, rhodium, rubber, silicon, silver, steel, tantalum, tellurium, tin, titanium, Teflon, Torlon, Ultem, zinc, and zirconium.

Head 12 of this second embodiment is individually depicted in FIG. 2B and tail 32 is individually depicted in FIG. 2C.

Figure 3A:
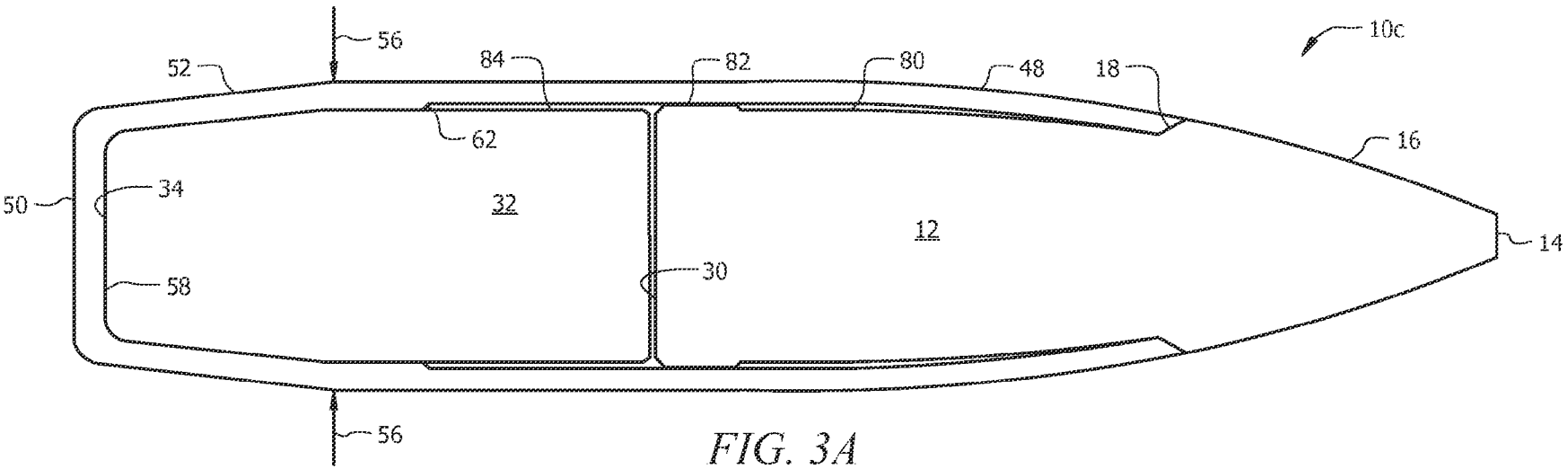
FIG. 3A is a longitudinal sectional view of a third embodiment of the novel projectile assembly.
Figure 3B:
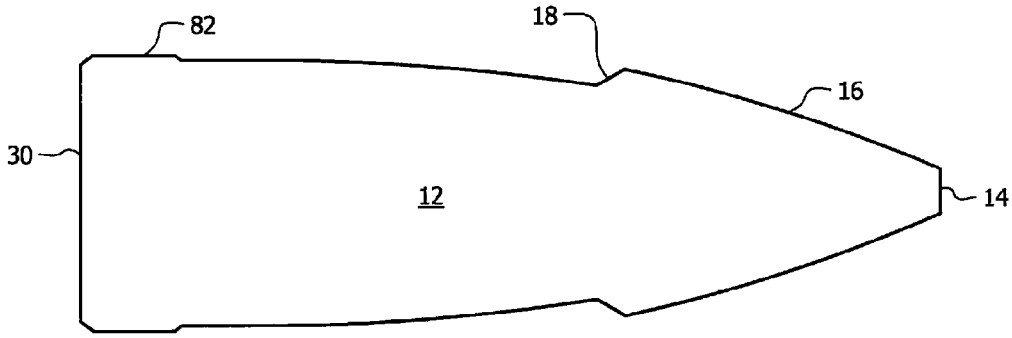
FIG. 3B is a longitudinal sectional view of the projectile head of the second third embodiment.
Figure 3C:
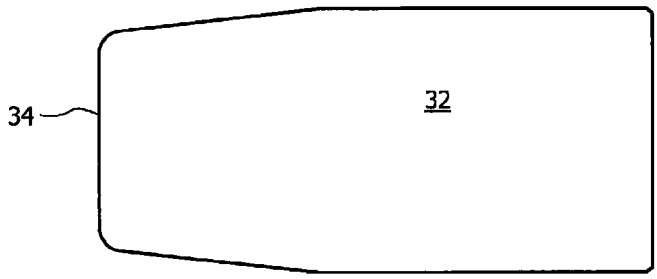
FIG. 3C is a longitudinal sectional view of the projectile tail of the third embodiment.

The third embodiment is depicted in FIGS. 3A, 3B, and 3C. It includes one annular recess 80 and one annular ridge 82 formed in head 12, said annular ridge 82 serving as a driving chamfer. The driving chamfer serves to impart synchronous spin between the two components thereby maintaining gyroscopic stability in flight. Annular ridge 82 is formed in the trailing end of head 12 as in the second embodiment but annular recess 80 formed in head 12 in leading relation to annular ridge 82 extends to or almost to annular diameter-reducing step 18 formed in head 12. As in the second embodiment, annular diameter-reducing step 18 is formed in head 12 about one-third the distance from the leading end of the head to its trailing end. The depth of annular recess 80 gradually reduces as it approaches annular diameter-reducing step 18.

Second annular recess 84 extends from annular diameter-increasing step 62 formed in the interior surface of interface 48 to annular ridge 82 formed in the trailing end of head 12.

Head 12 of this third embodiment is individually depicted in FIG. 3B and tail 32 is individually depicted in FIG. 3C.

It will be seen that the advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

What is claimed is:

1. A projectile, comprising:

a head, a tail, and an interface that interconnects said head and said tail;

a diameter-reducing annular step of predetermined depth formed in said head;

said interface having an open leading end, a closed trailing end, an exterior surface, and a cavity defined by an interior surface;

a diameter-increasing annular step formed in said interior surface of said interface, said diameter-increasing annular step increasing the diameter of said cavity;

said diameter-increasing annular step creating an annular space between a predetermined extent of said tail and said interface;

said exterior surface of said interface having a leading end, a trailing end, a mid-section, and a trailing section that extends from said trailing end to said mid-section and which gradually increases in diameter;

an annular obturation region formed where said trailing section and said mid-section merge with one another;

said leading end of said interface abutting said diameter-reducing annular step formed in said head, said leading end of said interface having a thickness equal to said predetermined depth of said diameter-reducing annular step, an exterior surface of said head and an exterior surface of said interface being flush with one another;

an annular ridge of predetermined height and extent formed in a trailing end of said head;

an annular recess of predetermined depth and extent formed in said head in leading relation to said annular ridge;

said annular recess having a first, truncate part having a longitudinal extent about the same extent as the longitudinal extent of said annular ridge; and said annular recess having a second, elongate part that extends from a leading end of said first, truncate part to said diameter-reducing annular step formed in said head.

2. The projectile of claim 1, further comprising:

a concavity formed in a leading wall of said tail said concavity adapted to receive a protuberance formed in a trailing wall of said head.

3. A projectile, comprising:

a head, a tail, and an interface that interconnects said head and said tail;

said head having a leading end and a trailing end;

said head including a frusto-conical section extending from said leading end of said head to an annular point about one-third the distance from said leading end of said head to said trailing end of said head;

a diameter-reducing annular step of predetermined depth formed in said head at said annular point;

a leading end of said interface abutting said diameter-reducing annular step, said leading end of said interface having a thickness equal to said predetermined depth of said diameter-reducing annular step so that an exterior surface of said head and an exterior surface of said interface are flush with one another at said annular step;

an annular ridge of predetermined height and extent formed in a trailing end of said head;

an annular recess of predetermined depth and extent formed in said head in leading relation to said annular ridge;

said interface having an open leading end, a closed trailing end, an exterior surface, and a cavity defined by an interior surface;

an annular diameter-increasing step formed in said interior surface of said interface about mid-length of a tail-receiving section of said interface, said annular diameter-increasing step creating an annular space between said interior surface of said interface and an exterior surface of said tail;

said annular recess extending from said annular diameter-increasing step to said leading end of said tail;

said head having a trailing wall disposed in abutting relation to a leading wall of said tail;

said interface having first and second annular sections that are deformable radially inwardly so that said first and second annular sections are respectively disposed in said annular recess formed in said head and in said annular space between said diameter-increasing step formed in said interior surface of said interface and said exterior surface of said tail so that each of said annular sections conform to the contour of said head and tail when said first and second annular sections are deformed radially inwardly;

the depth and extent of each deformation being controlled by said predetermined depth and extent of said annular recesses.

4. A projectile, comprising:

a head, a tail, and an interface that interconnects said head and said tail;

said head having a leading end and a trailing end;

said head including a frusto-conical section extending from said leading end of said head to an annular point about one-third the distance from said leading end of said head to said trailing end of said head;

a diameter-reducing annular step of predetermined depth formed in said head at said annular point;

a leading end of said interface abutting said diameter-reducing annular step, said leading end of said interface having a thickness equal to said predetermined depth of said diameter-reducing annular step so that an exterior surface of said head and an exterior surface of said interface are flush with one another at said annular step before and after said projectile is fired;

an annular ridge of predetermined height and extent formed in a trailing end of said head;

an elongate annular recess of predetermined longitudinal extent and depth formed in said head in leading relation to said annular ridge, said annular recess extending from said annular ridge to said diameter-reducing annular step and gradually reducing in depth as it approaches said diameter-reducing annular step;

said interface having an open leading end, a closed trailing end, an exterior surface, and a cavity defined by an interior surface;

an annular diameter-increasing step formed in said interior surface of said interface about mid-length of a tail-receiving section of said interface;

said annular diameter-increasing step creating an annular space between an interior surface of said interface and an exterior surface of said tail;

said exterior surface of said interface having a leading end, a trailing end, a mid-section having a diameter greater than a diameter of said trailing end, and a trailing section that extends from said trailing end to said mid-section;

an annular obturation band of predetermined extent, said obturation band being formed where said trailing section merges with said mid-section;

said head having a trailing wall disposed in abutting relation to a leading wall of said tail.

5. A projectile, comprising:

a head, a tail, and an interface that interconnects said head to said tail;

said interface having an open leading end, a closed trailing end, an exterior surface, and a cavity defined by an interior surface;

said tail fully disposed within said cavity;

said head having a trailing end disposed within said cavity in abutting relation to a leading end of said tail, and said head having a leading end that projects in a leading direction out of said cavity;

a diameter-increasing annular step formed in said interior surface of said interface about mid-length of said tail;

a first annular ridge formed in said trailing end of said head;

an annular recess formed in said head in leading relation to said first annular ridge;

said annular recess having a longitudinal extent substantially equal to a longitudinal extent of said first annular ridge;

a diameter-decreasing annular step formed in said head;

a first longitudinally-extending annular space created by said diameter-increasing annular step, said first annular space being between said interior surface of said interface and an exterior surface of said tail, said first annular space extending from said diameter-increasing annular step to said first annular ridge;

a second longitudinally-extending annular space extending from said annular recess to said diameter-decreasing annular step;

whereby said interface is configured to be deformed by rifling and occupies said first longitudinally-extending annular space when said projectile is fired.

6. A projectile, comprising:

a head, a tail, and an interface that interconnects said head to said tail;

said interface having an open leading end, a closed trailing end, an exterior surface, and a cavity defined by an interior surface;

said tail fully disposed within said cavity;

said head having a trailing end disposed within said cavity in abutting relation to a leading end of said tail and said head having a leading end that projects in a leading direction out of said cavity;

a diameter-increasing annular step formed in said interior surface of said interface;

a first annular ridge formed in said trailing end of said head;

an annular diameter-reducing step formed in said head, said leading end of said interface abutting said annular diameter-reducing step;

a first longitudinally-extending annular space created by said diameter-increasing annular step, said first longitudinally-extending annular space being between said interior surface of said interface and an exterior surface of said tail and extending from said diameter-increasing annular step to said trailing end of said head;

a second longitudinally-extending annular space between said interior surface of said interface and an exterior surface of said head, said second longitudinally-extending annular space extending longitudinally from said first annular ridge to said annular diameter-reducing step;

whereby said interface is configured to be deformed by rifling and occupies said first longitudinally-extending annular space when said projectile is fired.

7. A projectile, comprising:

a head, a tail, and an interface that interconnects said head to said tail;

said interface having an open leading end, a closed trailing end, an exterior surface, and a cavity defined by an interior surface;

said tail fully disposed within said cavity;

said head having a trailing end disposed within said cavity in abutting relation to a leading end of said tail, and said head having a leading end that projects in a leading direction out of said cavity;

a diameter-increasing annular step formed in said interior surface of said interface about mid-length of said tail;

a first annular ridge formed in said trailing end of said head;

an annular recess formed in said head in leading relation to said first annular ridge;

said annular recess having a longitudinal extent substantially equal to a longitudinal extent of said first annular ridge;

a diameter-decreasing annular step formed in said head;

a first longitudinally-extending annular space created by said diameter-increasing annular step, said first annular space being between said interior surface of said interface and an exterior surface of said tail, said first annular space extending from said diameter-increasing annular step to said first annular ridge;

a second longitudinally-extending annular space extending from said annular recess to said diameter-decreasing annular step;

whereby said interface is configured to be deformed by a die and occupies said first longitudinally-extending annular space before said projectile is fired.

8. A projectile, comprising:

a head, a tail, and an interface that interconnects said head to said tail;

said interface having an open leading end, a closed trailing end, an exterior surface, and a cavity defined by an interior surface;

said tail fully disposed within said cavity;

said head having a trailing end disposed within said cavity in abutting relation to a leading end of said tail and said head having a leading end that projects in a leading direction out of said cavity;

a diameter-increasing annular step formed in said interior surface of said interface;

a first annular ridge formed in said trailing end of said head;

an annular diameter-reducing step formed in said head, said leading end of said interface abutting said annular diameter-reducing step;

a first longitudinally-extending annular space created by said diameter-increasing annular step, said first longitudinally-extending annular space being between said interior surface of said interface and an exterior surface of said tail and extending from said diameter-increasing annular step to said trailing end of said head;

a second longitudinally-extending annular space between said interior surface of said interface and an exterior surface of said head, said second longitudinally-extending annular space extending longitudinally from said first annular ridge to said annular diameter-reducing step;

whereby said interface is configured to be deformed by a die and occupies said first longitudinally-extending annular space before said projectile is fired.

* * * * *